US009638465B2

(12) United States Patent
Lee et al.

(10) Patent No.: US 9,638,465 B2
(45) **Date of Patent: *May 2, 2017**

(54) CLOTHES TREATING APPARATUS HAVING DRYING FUNCTION

(71) Applicant: LG Electronics Inc., Seoul (KR)

(72) Inventors: Yongju Lee, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 143 days.

This patent is subject to a terminal disclaimer.

(21) Appl. No.: 13/739,185

(22) Filed: Jan. 11, 2013

(65) Prior Publication Data

US 2013/0180126 A1 Jul. 18, 2013

(30) Foreign Application Priority Data

Jan. 13, 2012 (KR) ..... 10-2012-0004426

(51) Int. Cl.
*D06F 58/26* (2006.01)
*D06F 58/20* (2006.01)
(Continued)

(52) U.S. Cl.
CPC ..... *F26B 23/00* (2013.01); *D06F 58/02* (2013.01); *D06F 58/20* (2013.01); *D06F 58/26* (2013.01); *D06F 2058/289* (2013.01)

(58) Field of Classification Search
CPC ..... F26B 23/00; F26B 23/001; F26B 23/002; F26B 23/007; D06F 58/02; D06F 58/26; D06F 58/20; D06F 2058/289
See application file for complete search history.

(56) References Cited

U.S. PATENT DOCUMENTS 2,776,826 A * 1/1957 Bennett ..... D06F 58/02 34/82
3,325,908 A 6/1967 Gartley
(Continued)

FOREIGN PATENT DOCUMENTS

CN 101575796 A 11/2009
CN 201648799 U 11/2010
(Continued)

OTHER PUBLICATIONS

Combined Search and Examination Report dated Apr. 30, 2013 from GB Application No. 1300591.3, in English, 5 pages.
(Continued)

*Primary Examiner* — Kenneth Rinehart
*Assistant Examiner* — Tavia Sullens
(74) *Attorney, Agent, or Firm* — Fish & Richardson P.C.

(57) ABSTRACT

A clothes treating apparatus having a drying function comprises a cabinet to receive a rotatable drum therein, the cabinet defining an appearance of the apparatus, a module part mounted onto an outer surface of the cabinet, the module part comprising a heater assembly, a blower assembly, and a housing for accommodating the heater assembly and the blower assembly, and a link unit to connect the module part onto the rear side of the cabinet, wherein the heater assembly includes a heater module as an air heating device, a thermostat installed at a position adjacent to an outlet side of the heater module to turn the heater module on or off according to air temperature, and a slit formed between the thermostat and the heater module to allow for introduction of external air.

12 Claims, 19 Drawing Sheets

(51) Int. Cl.

| | |
|---|---|
| ***D06F 58/02*** | (2006.01) |
| ***F26B 23/00*** | (2006.01) |
| *D06F 58/28* | (2006.01) |

(56) References Cited

U.S. PATENT DOCUMENTS

| | | | | |
|---|---|---|---|---|
| 3,583,688 | A | | 6/1971 | Fuqua et al. |
| 4,268,247 | A | * | 5/1981 | Freze ..... 34/77 |
| 4,498,317 | A | | 2/1985 | Thysen et al. |
| 5,713,139 | A | | 2/1998 | Briggs |
| 5,819,437 | A | | 10/1998 | Briggs |
| 2006/0218817 | A1 | | 10/2006 | Lee |
| 2010/0192639 | A1 | | 8/2010 | Kim et al. |

FOREIGN PATENT DOCUMENTS

| | | | |
|---|---|---|---|
| CN | 201873878 | U | 6/2011 |
| CN | 102282303 | A | 12/2011 |
| DE | 8328232 | | 4/1984 |
| DE | 102008019549 | A1 | 11/2008 |
| EP | 1 634 984 | A1 | 3/2006 |
| GB | 712008 | A | 7/1954 |
| JP | 60-005199 | A | 1/1985 |

OTHER PUBLICATIONS

Office Action dated Aug. 29, 2014 from corresponding Chinese Patent Application No. 201310011807.0, 16 pages.

Search Report issued Sep. 1, 2015 from corresponding French Patent Application No. 1350201, 11 pages.

Office Action issued Mach 16, 2016 from corresponding German Patent Application No. 102013000123.4, 16 pages, with English translation.

* cited by examiner

CLOTHES TREATING APPARATUS HAVING DRYING FUNCTION

CROSS-REFERENCE TO RELATED APPLICATION

Pursuant to 35 U.S.C. §119(a), this application claims the benefit of earlier filing date and right of priority to Korean Application No. 10-2012-0004426, filed on Jan. 13, 2012, the contents of which is incorporated by reference herein in its entirety.

BACKGROUND OF THE INVENTION

1. Field of the Invention

This specification relates to a clothes treating apparatus having a drying function capable of drying clothes and the like, and particularly, to a clothes treating apparatus having a drying function capable of fast drying a large quantity of targets to be dried by employing a heater assembly, separate from a cabinet having a drum and the like therein, for drying such large quantity of targets to be dried.

2. Background of the Invention

In general, a clothes treating apparatus refers to an apparatus having at least one of a dehydrating function and a drying function for clothes. For example, a drying machine as one of clothes treating apparatuses is an apparatus for drying a target to be dried by introducing the target to be dried into a drum and evaporating moisture contained in the target with supplying air into the drum. A washing machine having a drying function is an apparatus capable of drying clothes, which has been dehydrated after washed, with hot air.

A typical dryer includes a drum rotatably installed within a main body or a cabinet and receiving clothes therein, a driving motor for driving the drum, a blower fan for generating the flow of air supplied into the drum or discharged from the drum, and a heating device for heating up the air introduced into the drum. The heating unit may be implemented as a heater type which uses high temperature electric resistance heat generated by electrical resistance or heat of combustion generated by burning gas.

In the meantime, air discharged out of the drum contains moisture from the clothes within the drum, to become air in a state of high temperature and high humidity. Here, dryers may be classified, according to how to process such hot humid air, into a circulating type in which hot humid air is cooled below a dew point temperature through a heat exchanger while circulating without being discharged out of a dryer such that moisture contained within the hot humid air can be condensed to be resupplied, and an exhausting type in which hot humid air passed through a drum is discharged directly to the outside.

The aforementioned typical dryer includes a drum, a driving motor, a blower fan and a heater all disposed within a single main body. Hence, a size of a cabinet or main body and sizes of elements such as the driving motor and the heater are decided depending on the size of the drum.

Here, a capacity of a dryer depends on not only the size of the drum but also a quantity of air supplied into the drum and a quantity of heat or energy to be supplied by the heater. Therefore, even if the drum is large in size, if air and heat are not sufficiently supplied, a drying performance of the dryer does not come up to the size of the drum. Also, even for a drum of the same size, if air and heat are fully supplied into the drum, the drying performance of the dryer may be more improved.

A household clothes dryer is installed within a limited space, which results in a limited size of a main body of the dryer. Accordingly, the size of the blower fan and the size of the heater are limited. Hence, a drying capacity of the dryer is limited, but there is not a problem because of less necessity of using a capacity more than that.

However, a dryer which is used in a commercial place such as a laundromat or an industrial dryer must have a capacity, which is large enough to dry a large quantity of clothes. Therefore, a dryer with a large capacity has to be used.

To dry the large quantity of clothes, the main body of the dryer may have an increased size and accordingly the blower fan and the heater as well as the drum may also be fabricated with large sizes. Here, a separate dryer main body is fabricated for the industrial dryer, unlike the household clothes dryer. That is, the main body of the household clothes dryer is unable to be used in the industrial dryer. Consequently, a manufacturer has to produce a separate dryer main body, and a user is unable to use the dryer main body which is being used at home.

Meanwhile, even with a structure of connecting a separate heater onto a main body of a dryer, the heater may be overheated due to its large capacity. A thermostat may be used to prevent the problem.

A thermostat may control the heater to be turned on or off by measuring ambient temperature. When external air sufficiently flows, the external air is fully supplied into the heater, which reduces the probability that the heater is overheated. However, without a flow of external air, the heater is overheated and accordingly a heating wire of the heater may be expanded or shorted by heat. Therefore, the thermostat has to be installed at a position where a great temperature difference is detected between a temperature of air when air heated by the heater flows and a temperature of air when such air does not flow. However, it is difficult to correctly set a point at which a great air temperature difference is detected. This may cause the thermostat to erroneously operate, resulting in an occurrence of a problem associated with safety.

Further, the thermostat has to be mounted at a position spaced apart from the heater by a predetermined gap. If not, it may be affected by radiant heat of the heater. This may cause the thermostat to operate erroneously.

SUMMARY OF THE INVENTION

Therefore, the present disclosure is to solve the problems of the related art.

An aspect of the detailed description is to provide a clothes treating apparatus having a drying operation, capable of drying a large quantity of clothes by connecting a large heater and a large blower fan to a random clothes treating apparatus, especially, a clothes treating apparatus having a drying operation, capable of improving efficiency by allowing a thermostat to turn a heater module off only when external air is not smoothly introduced, so as to prevent the heater module from being unnecessarily turned off by the thermostat.

Another aspect of the detailed description is to provide a clothes treating apparatus having a drying function, capable of improving convenience in operation and spatial efficiency by conveniently deciding a mounting position of a thermostat and installing the thermostat adjacent to a heater.

Another aspect of the detailed description is to provide a clothes treating apparatus having a drying operation, capable of drying a large quantity of clothes using a large heater and a large blower fan, irrespective of a size of a main body of the apparatus, by virtue of employing a module part, separate from a cabinet having a drum and the like therein.

Another aspect of the detailed description is to provide a clothes treating apparatus having a drying operation, capable of reducing requirement for producing a separate cabinet due to being connectable to a random clothes treating apparatus, thereby increasing generality and usability and reducing fabricating costs.

Another aspect of the detailed description is to provide a clothes treating apparatus having a drying operation, capable of increasing a quantity of air used for drying a large quantity of clothes by supplying air heated by a heat assembly into a drum of a main body without a loss, even if a separate module part is provided, and also capable of allowing the module part to be connected to a cabinet of a random clothes treating apparatus.

Another aspect of the detailed description is to provide a clothes treating apparatus having a drying operation, capable of exhibiting improved operation efficiency and stability.

Another aspect of the detailed description is to provide a clothes treating apparatus having a drying operation, capable of improving generality and usability by allowing for mounting a module part without using a separate connection member even when a plurality of clothes treating apparatuses are installed in a stacking manner for increasing a spatial usage.

To achieve these and other advantages and in accordance with the purpose of this specification, as embodied and broadly described herein, there is provided a clothes treating apparatus having a drying function, the apparatus comprising a cabinet adapted to receive a rotatable drum therein, the cabinet defining an appearance of the apparatus, a module part mounted onto an outer surface of the cabinet and comprising a heater assembly, a blower assembly and a housing, and a link unit configured to connect the module part onto the rear side of the cabinet. Here, the housing may receive the heater assembly and the blower assembly therein. The heater assembly may comprise a heater module as an air heating device, a thermostat installed at a position adjacent to an outlet side of the heater module to turn the heater mode on or off according to air temperature, and a slit formed between the thermostat and the heater module to allow for introduction of external air therethrough.

In the clothes treating apparatus, air to be used for drying in the drum may be supplied into the drum after being heated through the heater assembly, and air used for drying in the drum may be externally discharged via the blower assembly.

With the configuration, the heater assembly and the blower assembly are separately disposed as a module part at the outside of the cabinet. Accordingly, a large heater and a large blower fan may be used regardless of the size of the cabinet of the apparatus, allowing for drying a large quantity of clothes or laundry. In addition, the module part may be connectable to a random apparatus, which may reduce requirement for fabricating a separate cabinet of the apparatus, resulting in improvement of generality and usability and reduction of fabricating costs.

Here, external air introduced into the housing may be transferred to the heater assembly.

In accordance with one exemplary embodiment, the air used for drying in the drum may be discharged to a front lower side of the drum, and then transferred to the blower assembly after removing foreign materials therefrom.

In accordance with one exemplary embodiment, at least part of air discharged to the outside through the blower assembly may be transferred to the heater assembly.

With the configuration, the air discharged from the drum may partially be recycled, so as to reduce a heating time, resulting in improvement of efficiency of the heater assembly and reduction of power consumption.

In accordance with one exemplary embodiment, the slit may introduce external air therethrough to form a blocking flow by the external air for blocking air heated by the heater module from contacting the thermostat. However, the slit may allow the thermostat to contact the air heated by the heater module when external air is not introduced therethrough.

With the configuration, to prevent the thermostat from unnecessarily turning the heater module off, the thermostat may be allowed to turn the heater module off only when external air is not smoothly introduced. This may result in improvement of efficiency of the apparatus.

A mounting position of the thermostat may be conveniently decided and be located adjacent to a heater, thereby improving convenience in operation and spatial efficiency.

In accordance with one exemplary embodiment, the heater assembly may further include a passage guide to guide the flow path of the external air introduced through the slit. Here, the passage guide may be formed beneath the slit and extend toward the thermostat.

Also, in accordance with one exemplary embodiment, the passage guide may have a shape whose width is reduced as extending toward the thermostat.

With the configuration, the external air, which is introduced through the slit so as to form the blocking flow, may flow more smoothly, so as to prevent the heater module from being unnecessarily turned off by the thermostat, resulting in improvement of efficiency of the apparatus.

In accordance with one exemplary embodiment, the housing may include at least one air inlet port to supply external air into the heater assembly.

In accordance with one exemplary embodiment, the heater assembly may further include a heater casing. The heater module and the thermostat may be mounted within the heater casing, and the slit may be formed on the heater casing.

The present disclosure having the configurations may provide the following effects.

A heater module may be turned off by a thermostat only when external air is not smoothly introduced. This may prevent the heater module from being unnecessarily turned off by the thermostat, resulting in improvement of efficiency of the clothes treating apparatus.

Also, a mounting position of the thermostat may be conveniently decided and be located adjacent to a heater, thereby improving convenience in operation and spatial efficiency.

A module part having a heater assembly and a blower assembly may be employed, separate from a cabinet of a clothes treating apparatus. This may allow for use of a large heater and a large blower fan, irrespective of a size of a main body of the apparatus, thereby enabling the clothes treating apparatus to dry a large quantity of clothes.

The employed module part may be connectable to a random clothes treating apparatus, which may reduce the requirement for fabricating a separate cabinet of the apparatus, thereby improving generality and usability and reducing fabricating costs.

In addition, a bypass unit may further be employed to bypass a part of air, which is externally discharged from the blower assembly, toward the heater assembly, thereby reducing power consumption by the heater module and a drying time of the apparatus during a drying operation.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
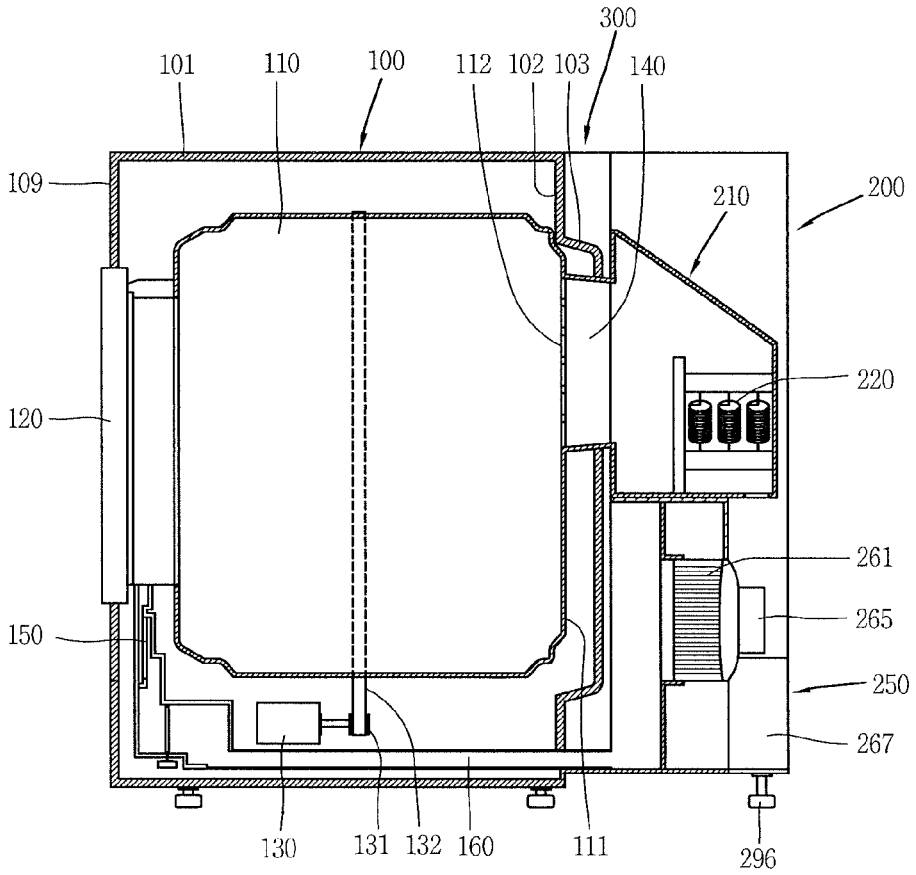
FIG. 1 is a schematic view of a clothes treating apparatus having a drying operation in accordance with one exemplary embodiment.

FIG. 1 is a schematic view of a clothes treating apparatus having a drying function in accordance with one exemplary embodiment. This exemplary embodiment illustrates a drying machine. However, the present disclosure may not be limited only to the drying machine, but applicable to a clothes treating apparatus, for example, a washing machine having a drying function and the like, which dries clothes by supplying air or hot air into a drum.

As shown in FIG. 1, a dryer according to one exemplary embodiment may include a main body 100 having a rotatable drum within a cabinet, a module part 200 having a heater assembly and a blower assembly and connectable to the rear of the cabinet, and a link unit 300 for connecting the module part onto the rear of the cabinet.

The main body 100 of the dryer may include a cabinet 101 defining an appearance of the dryer, a drum 110 rotatably installed within the cabinet 101, and a door 120 mounted onto a front surface of the cabinet 101.

The cabinet 101 shown in FIG. 1 is a widely used box type cabinet. However, the present disclosure may not be limited to the box type. The cabinet 101 may be formed by a front panel 109 forming a front surface, a rear panel 102 forming a rear surface, a base panel and a top panel forming a bottom surface and a top surface, and side panels forming both side surfaces.

The front panel 109 of the cabinet 101 may be provided with an inlet port for introducing clothes as a target to be dried into the drum 110, so as to form a path connected to the drum 110. The inlet port may be open or closed by the door 120 rotatably mounted onto the front panel 109. A control panel (not shown) which includes various manipulation buttons and a display device may be provided above the inlet port.

The drum 110 may be rotatably installed within the cabinet 101 to dry the clothes therein. The drum 110 may be rotatably supported within the cabinet 101 by supporters (not shown) at front and rear sides thereof. The front side of the drum 110 may be open to be connected to the inlet port, and the rear side of the drum 110 may be closed by a drum back 111 which forms an inner surface of the drum 110. Here, the front side of the drum 110 is open but a space for receiving the clothes may be entirely closed by the door 120. The drum 110 may be rotatable with respect to the cabinet 101 but the drum back 111 may be fixed onto the cabinet 101.

The drum 110 may have a cylindrical shape, and be connected to a driving motor 130, which is disposed at a lower portion of the dryer, by a power transfer belt 132, so as to receive a rotational force from the driving motor 130. The driving motor 130 may have a pulley 131 at its one side, and the power transfer belt 132 may be connected to the pulley 131.

The drum back 111 of the drum 110 may face the rear panel 102 of the cabinet 101. Here, the rear panel 102 may have a protruding portion 103 which partially protrudes from the rear panel 102 to the outside based on a size or length of the drum 110. Accordingly, the rear panel 102 may have a reinforced rigidity by virtue of the protruding portion 103.

The drum 110 may receive heated air to be used for drying via an outlet port 112 formed on the drum back 111. The heated air to be used for drying may be generated by heating external air in a heater assembly 210 of the module part 200 to be explained later.

Figure 2:
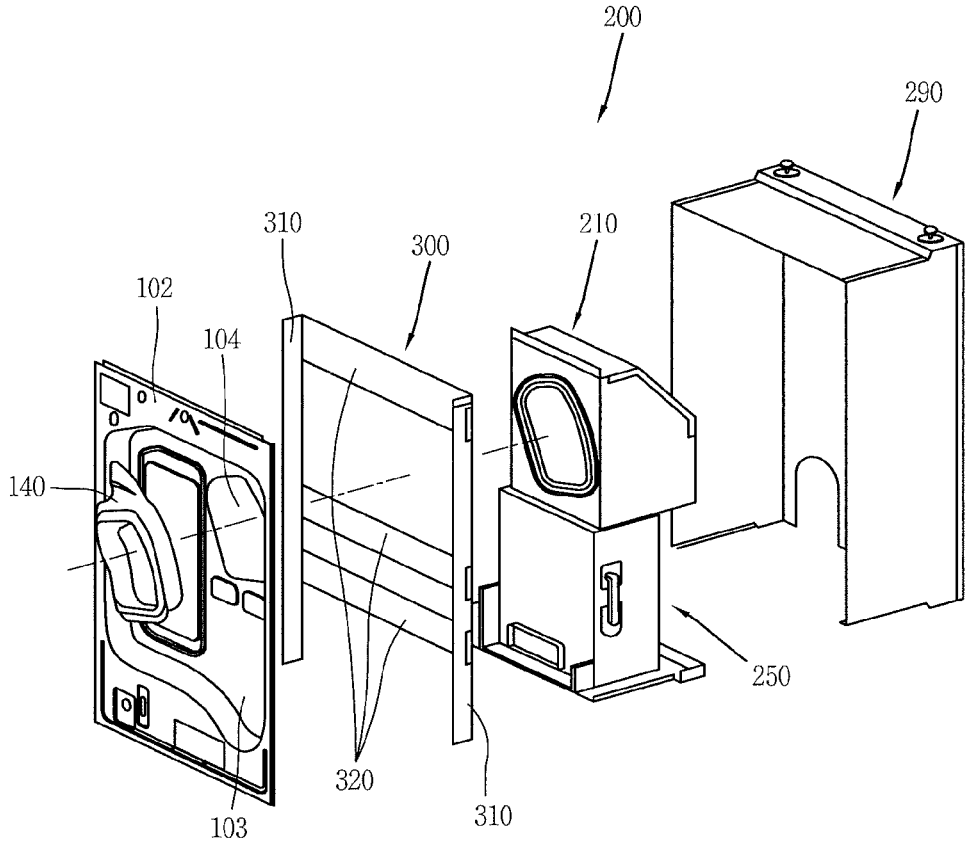
FIG. 2 is a schematic view showing a module part mounted within a cabinet of the dryer and a link unit for mounting the module part.

FIG. 2 shows the module part 200 mounted in the cabinet 101 of the dryer and the link unit 300 for mounting the module part 200. As shown in FIG. 2, the module part 200 may be connected to the rear of the cabinet 101. Therefore, to supply heated air generated in the module part 200 at the rear of the cabinet 101 into the drum 110, a through hole 104 may be formed through the rear panel 102. Also, the cabinet 101 may be provided with a connecting duct 140 for communicating the drum 110 with the heater assembly 210 of the module part 200.

Figure 3:
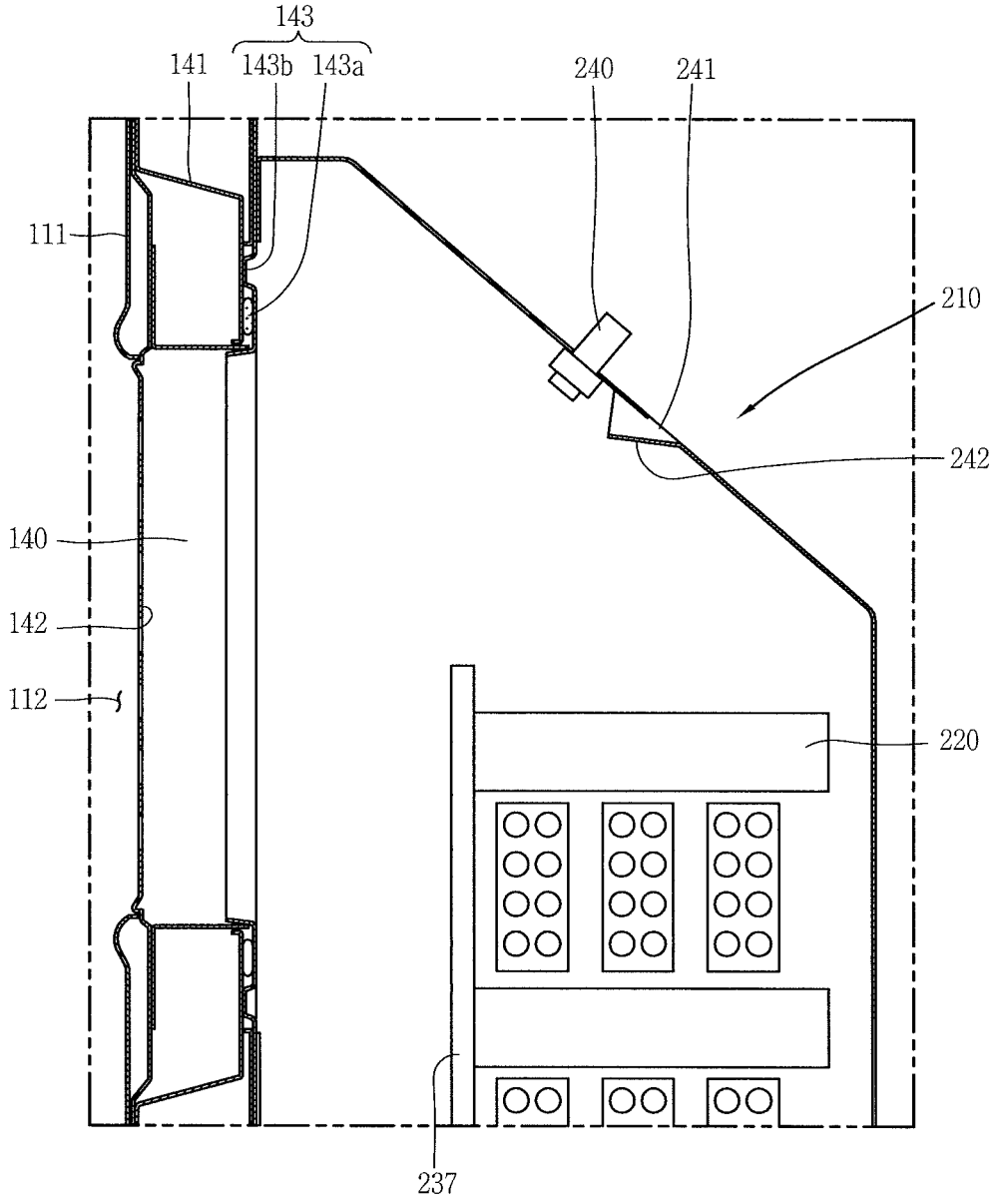
FIG. 3 is a sectional view showing that a heater assembly communicates with a drum via a connecting duct.
Figure 4:
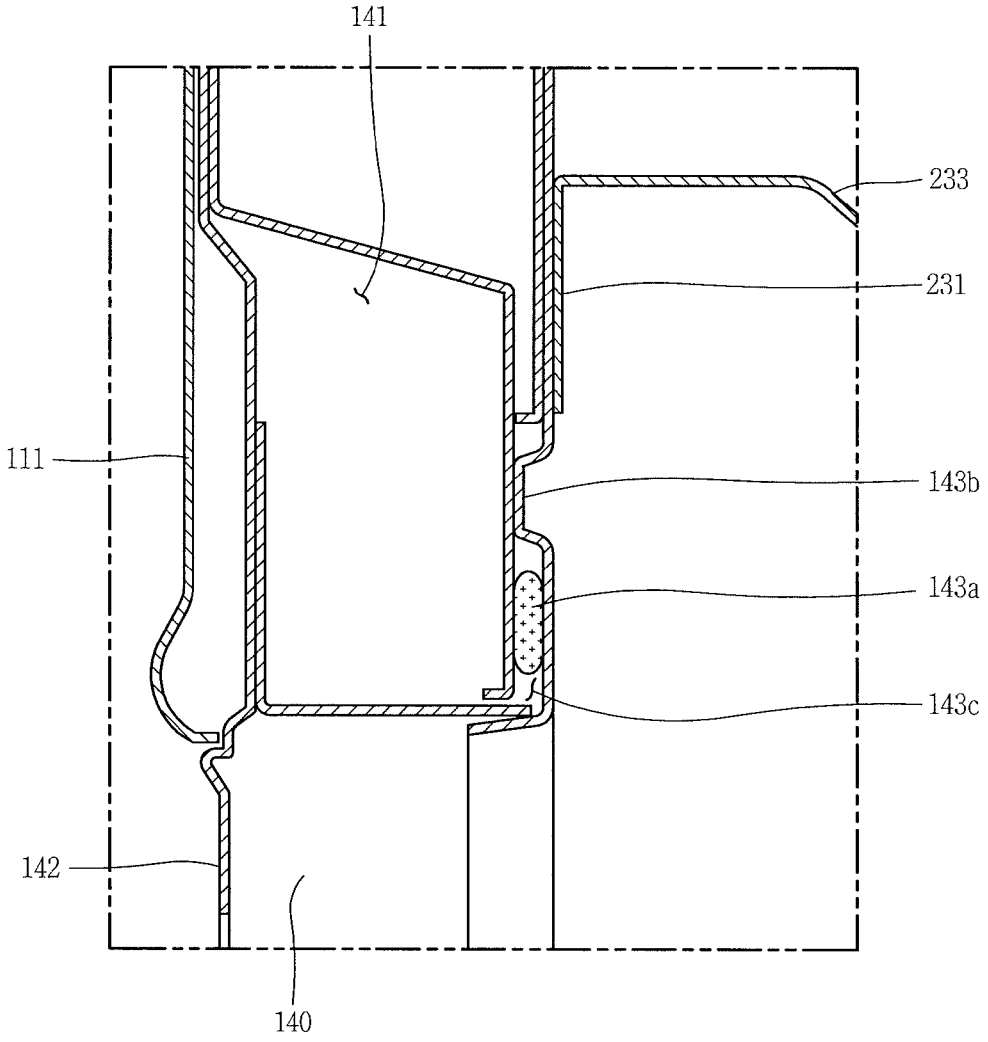
FIG. 4 is an enlarged sectional view showing the connecting duct in detail.

FIGS. 3 and 4 show the connecting duct 140 in more detail. As shown in FIG. 3, the connecting duct 140 may be mounted onto the main body 110 to be connected to the drum back 111 via the rear panel 102. The drum back 111 may also be provided with the outlet port 112. However, the outlet port 112 may be shielded by a porous plate 142 disposed on the connecting duct 140. The porous plate 142 may function to filter off foreign materials and the like. The connecting duct 140 is a component for smoothly connecting the main body 100 and the module part 200 to each other in view of a passage of air to be used for drying.

The connecting duct 140 may include a sealing unit 143 for allowing the heated air supplied by the heater assembly 210 to be supplied only into the drum 110 via the drum back 111. The sealing unit 143 may be disposed on a border portion 141 of the connecting duct 140 on which the heater assembly 210 to be explained later contacts the connecting duct 140.

The sealing unit 143 may include a sealing member 143*a* for sealing a circumference of a portion where the connecting duct 140 and the heater assembly 210 contact each other, and a sealing bead 143*b* disposed at the outside of the sealing member 143*a* for sealing a circumference of the connecting duct 140. Also, the connecting duct 140 may include a receiving portion 143*c* for receiving the sealing member 143*a* therein.

The sealing member 143*a* may typically be made of ethylene propylene diene monomer (EPDM) synthetic rubber, for example. The sealing bead 143*b* is a component which is closely adhered onto one side of the receiving portion 143*c*, in which the sealing member 143*a* is received, at the outside of the sealing member 143*a*, thereby preventing the leakage of the heated air. Therefore, a part of the sealing bead 143*b* may be a partial surface of the receiving portion 143*c*.

From the perspective of the configuration, air heated by the heater assembly of the module part may be supplied into the drum without a loss so as to increase a quantity of air used for drying a large quantity of clothes. Also, the module part may be connectable even to a random dryer. This may result in improvement of generality and usability of the dryer. In addition, the configuration of the dryer may prevent an introduction of external cold air which is not heated, avoiding degradation of drying efficiency.

Meanwhile, a filter 150 for filtering off foreign materials such as lint contained in the air discharged out of the drum 110 may be installed below the front of the drum 110. Also, an exhaust duct 160 for exhausting the air, from which the foreign materials have been filtered off, out of the drum 110 may be installed. The exhaust duct 160 is named based on the point that the air is exhausted based on the drum.

The exhaust duct 160 may form a passage for transferring air within the drum 110 toward a blower assembly 250 to be explained later. A blower fan 261 which is disposed in the blower assembly 250 may generate a difference of pressure, and accordingly the exhaust duct 160 may suck the air contained within the drum 110.

The blower assembly 250 may be coupled to the rear panel 102 located at the rear of the cabinet 101. Hence, the exhaust duct 160 may extend from the front side toward the rear side of the drum 110 to be connected to the blower assembly 250 via the rear panel 102.

Air to be used for drying within the main body 110 of the dryer may be heated through the heater assembly 210 and then supplied into the drum 110 of the main body 100 via the connecting duct 140. The air after being used for drying in the drum 110 may be discharged to the outside via the exhaust duct 160 and the blower assembly 250.

In the meanwhile, the module part 200 may include a heater assembly 210 and a blower assembly 250 as components connected to the rear of the main body 100. Also, the module part 200 may include a housing 290, and the heater assembly 210 and the blower assembly 250 may be disposed within the housing 290.

Figure 5:
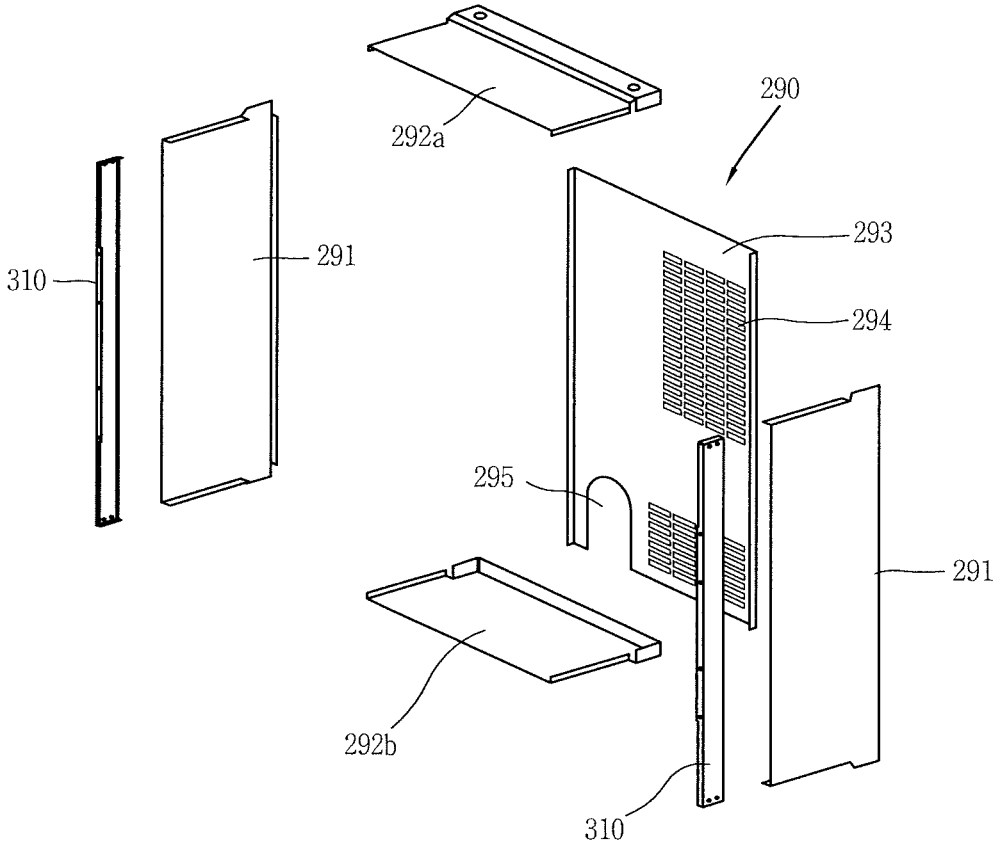
FIG. 5 is a disassembled perspective view of a housing of the module part.

FIG. 5 shows the housing 290 of the module part 200. Referring to FIG. 5, the housing 290 of the module part 200 may include both side surfaces 291, a rear surface 293, a lower surface 292*b* and an upper surface 292*a*. However, the housing 290 may not have a front surface because the module part 200 is coupled to the rear panel 102 of the main body 100.

The housing 290 may also include at least one air inlet port 294 through which external air flows in. FIG. 5 shows a plurality of air inlet ports 294 formed through the rear surface 293 of the housing 290 in form of a slit.

The housing 290 may also include an air outlet port 295 through which air discharged from the drum 110 is sucked via the blower assembly 250 and then discharged out of the module part 200. An exhaust port of the blower assembly 250 may penetrate through or be connected to the air outlet port 295.

Referring to FIG. 1, legs 296 for supporting the module part 200 with respect to the ground may be disposed on the lower surface 292*b* of the housing 290. The legs 296 may have a predetermined height to allow the lower surface 292*b* to be spaced apart from the ground. The legs 296 may be coupled to the lower surface 292*b* by screws. The detailed configuration of the leg is already well known, so detailed description thereof will be omitted.

Referring to FIG. 5, the lower surface 292*b* and the upper surface 292*a* of the housing 290 may have the same shape as each other. That is, the lower surface 292*b* may be used as the upper surface 292*a* when being turned upside down. Accordingly, the same component may be used as both the upper and lower surfaces, thereby improving convenience in operation. Also, this may be efficiently used in a stacking structure of a plurality of dryers which will be explained later.

Figure 6:
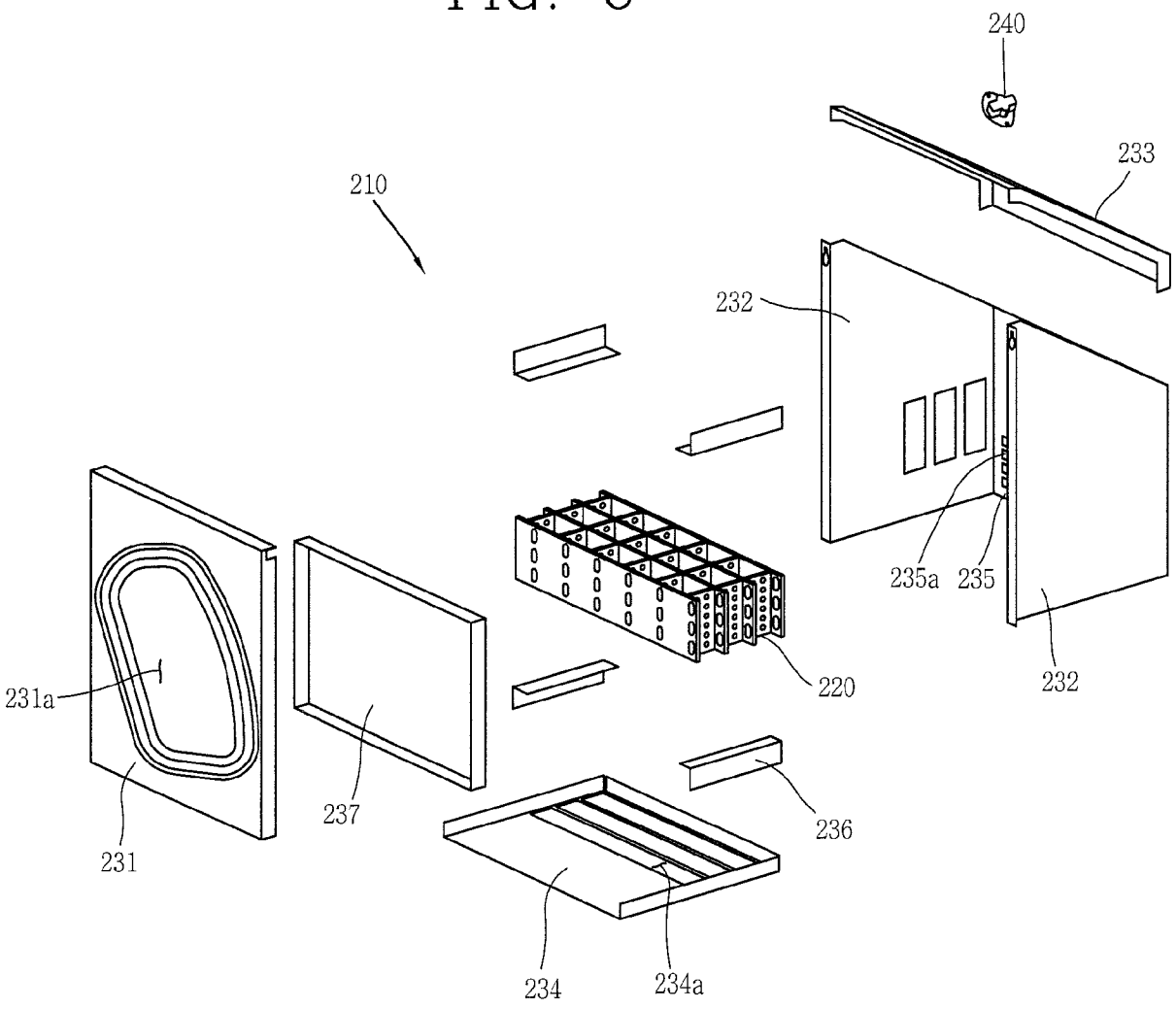
FIG. 6 is a disassembled perspective view of the heater assembly.

FIG. 6 shows the heater assembly 210. Referring to FIG. 6, the heater assembly 210 may include a heater casing 231, 232, 233, 234 and 235, a heater module 220 as a heating device disposed within the heater casing, and brackets 236 for mounting the heater module 220 in the heater casing.

The heater casing may include a front surface 231, a rear surface 235, both side surfaces 232, a lower surface 234 and an upper surface 233. The front surface 231 may be provided with a through hole 231*a* which is open such that heated air is supplied into the drum 110. The through hole 231*a* of the heater casing may be connected to the connecting duct 140 of the main body 100. The connecting duct 140 may be closely adhered onto the front surface 231 forming an outer side of the through hole 231*a*, such that the sealing unit 143 of the connecting duct 140 can prevent the heated air from being externally discharged.

The heater module 220 may have a structure that a plurality of heating elements are connected to a heater frame. The heater module 220 may be fixed onto the side surfaces 232 of the heater casing by the brackets 236. The brackets 236 may be fixed onto the heater casing by screws. FIG. 6 exemplarily shows four brackets 236, considering the weight of the heater module 220.

Figure 7:
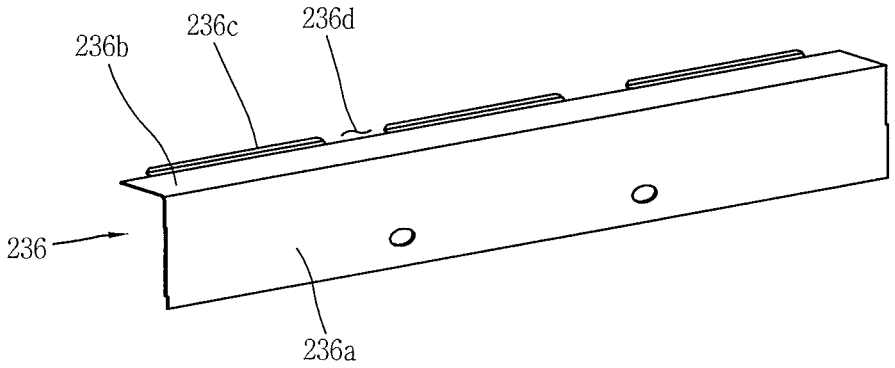
FIG. 7 is a perspective view of a bracket for securing a heater module to a heater casing.
Figure 8:
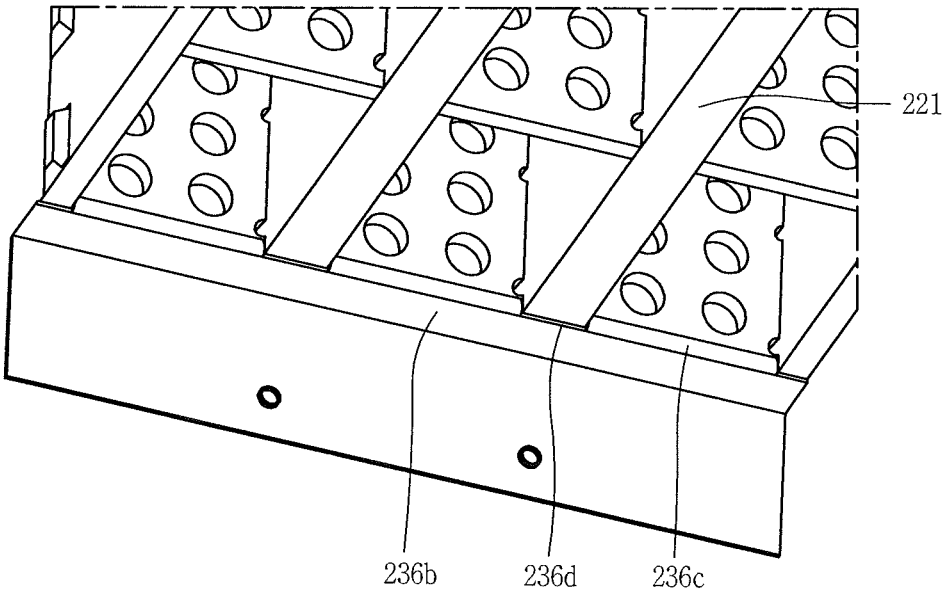
FIG. 8 is a perspective view showing a state that the heater module is coupled to the bracket.

FIG. 7 shows the bracket 236 in more detail, and FIG. 8 shows the state that the heater module 220 is mounted onto the bracket 236. Referring to FIG. 7, the bracket 236 may include a portion 236*a* coupled to the heater casing, and a portion 236*b* coupled to the heater module 220. A frame of the heater module 220 may be mounted onto the portion 236*b* coupled to the heater module 220 such that the heater module 220 can be supported.

In FIG. 7, a plurality of mounting ribs 236*c* for assisting the heater module 220 to be mounted onto a uniform mounting position may be formed on the portion 236*b* coupled to the heater module 220. The plurality of mounting ribs 236*c* may be spaced apart by uniform intervals so as to form mounting slots 236*d*.

Referring to FIG. 8, heater frames 221 of the heater module 220 may be engaged with the mounting slots 236*d*. Accordingly, the heater frames 221 may be located with the uniform intervals by the mounting ribs 236*c*. This may result in facilitation of the mounting of the heater module 220 and improvement of operation efficiency and stability of the dryer.

In the meantime, external air may be supplied into the heater module 220 via the heater casing and then heated. FIG. 6 shows at least one air inlet port 234*a* and 235*a* formed through the lower surface 234 and the rear surface 235, respectively, for introduction of external air therethrough. Here, positions of the air inlet ports formed through the heater casing may not be limited to those shown in FIG. 6.

Referring to FIG. 6, the heater assembly 210 may further include a middle plate 237 for blocking radiant heat generated in the heater module 220 from being directly transferred to the drum 120. The middle plate 237 may be located between the heater module 220 and the through hole 231*a* of the front surface 231. Accordingly, the middle plate 237 may form a passage of the heated air. Consequently, the air heated by the heater module 220 may flow through the upper surface 233 of the heater casing and be supplied into the drum 120 through the through hole 231*a* of the front surface 231.

Figure 9:
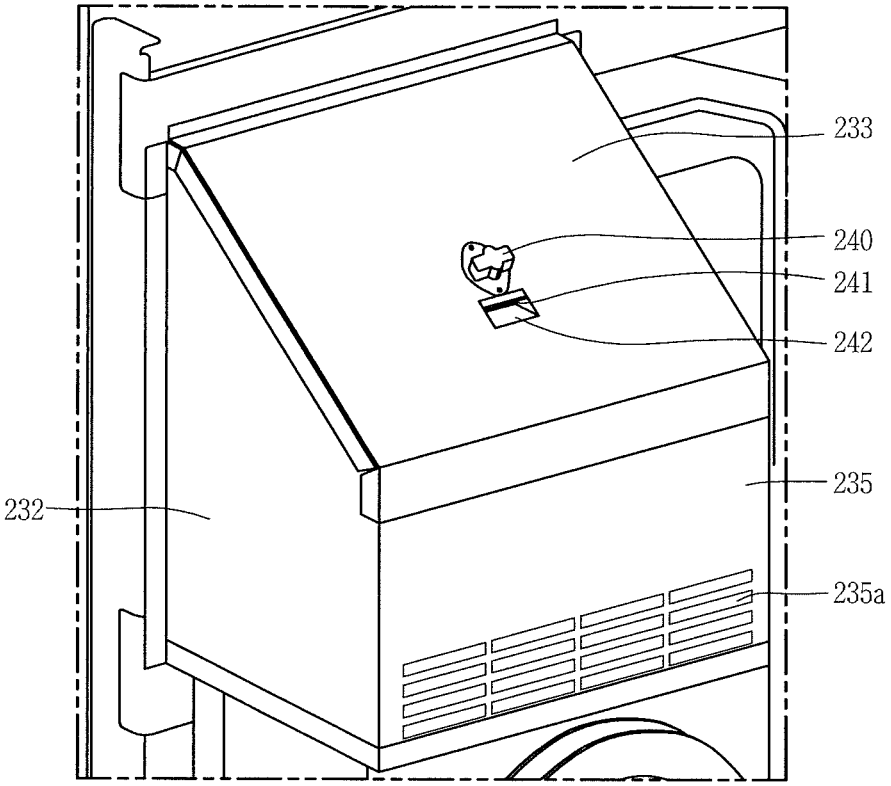
FIG. 9 is a schematic view showing that a thermostat is coupled to the heater assembly.

Referring to FIG. 9, the heater assembly 210 may include a thermostat 240 disposed on the upper surface 233 of the heater casing as a position adjacent to an outlet side of the heater module 220 so as to turn the heater module 220 on or off according to air temperature. Also, the heater assembly 210 may further include a slit 241 located between thermostat 240 and the heater module 220 for allowing introduction of external air therethrough.

Figure 10:
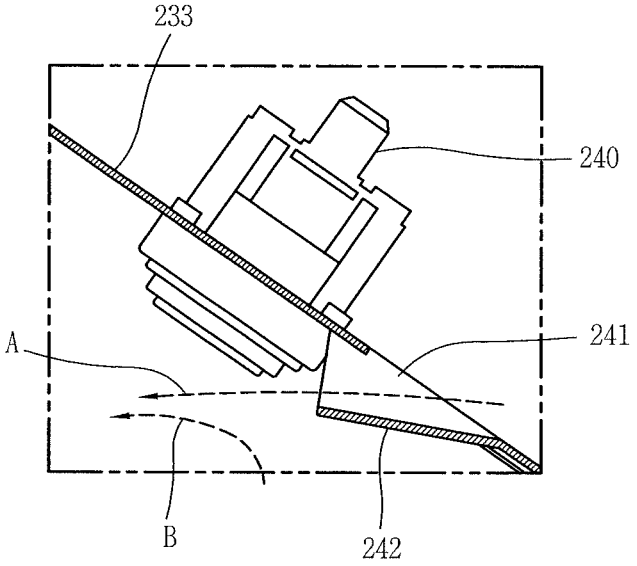
FIG. 10 is a schematic view showing that a shielding passage is formed by the thermostat and a slit.

FIG. 10 shows the slit 241 in more detail. Referring to FIG. 10, the slit 241 may be formed through the upper surface 233 of the heater casing. Here, the slit 241 may be formed directly through the upper surface 233 because the upper surface 233 of the heater casing has an inclination. However, if the upper surface of the heater casing is not inclined, the slit 241 may be formed through the rear surface 235 of the heater casing adjacent to the thermostat 240.

In FIG. 10, the slit 241 may form a blocking flow A by external air. Accordingly, air B heated by the heater module 220 may be blocked from flowing to the thermostat 240 due to the blocking flow A generated by external air introduced via the slit 241. That is, a considerable amount of the heated air B may be blocked by the blocking flow A without directly contacting the thermostat 240.

With the configuration, to prevent the heater module from being unnecessarily turned off by the thermostat, the turn-off of the heater module by the thermostat may be carried out only when external air is not smoothly introduced, thereby improving efficiency of the dryer. That is, when external air is smoothly introduced into the heater casing through the housing 290, the blocking flow A may also be formed by the slit, which may result in prevention of an unnecessary operation of the thermostat.

Also, a mounting position of the thermostat may be conveniently decided and the thermostat may be installed adjacent to a heater, thereby improving convenience in operation and spatial efficiency.

The structure will be described in more detail. A thermostat may control a heater to be turned on or off by measuring ambient temperature. When external air sufficiently flows into the heater casing, the external air is fully supplied into the heater, which reduces the probability that the heater is overheated.

However, without the flow of external air, the heater is overheated and accordingly a heating wire of the heater may be expanded or shorted by heat. Therefore, the thermostat has to be installed at a position where a great temperature difference is detected between a temperature of air when air heated by the heater flows and a temperature when such air does not flow.

It is, however, difficult to correctly set a position at which a great air temperature difference is detected. Here, the slit may generate the blocking flow by the external air, so as to make an obvious air temperature difference between a temperature of air when external air is introduced therethrough and a temperature of air when external air is not introduced therethrough.

That is, when the external air is introduced through the slit, air heated by the heater module may be blocked by the blocking flow, so as not to contact the thermostat. Accordingly, the temperature of air around the thermostat may be maintained in a low state. On the contrary, when the external air is not introduced through the slit, the blocking flow may not be generated. Accordingly, the temperature of air around the thermostat may be raised by the heater module. Hence, the thermostat may obviously detect the difference in air temperature between the temperature of air when the external air is introduced through the slit and the temperature of air when the external air is not introduced through the slit. This may not require for an effort to decide an accurate mounting position of the thermostat because the mounting position of the thermostat is not an issue. Consequently, convenience in operation may be improved.

Also, since the periphery of the thermostat 240 may be cooled by the blocking flow by the slit 241, the thermostat 240 may be installed to be more adjacent to the heater module 220. This may improve spatial efficiency, thereby reducing the size of the dryer.

In the meantime, when external air flows smoothly, a sufficient amount of air may be supplied into the heater module 220. It may not be likely to cause overheating of the heater module 220. Therefore, in this case, when the thermostat 240 sensitively operates, a heater may be unnecessarily turned on or off, which may cause an increase in a drying time and power consumption. To solve the problem, the slit 241 may generate the blocking flow by the external air to prevent the unnecessary operation of the thermostat, thereby improving the efficiency of the dryer.

In addition, the thermostat 240 may be likely to operate erroneously due to radiant heat of the heater module 220 because the radiant heat is not blocked by the blocking flow. The thermostat 240 may be provided with a bimetal therein and thus operate in response to the change in temperature. Therefore, the thermostat 240 may operate in response to the radiant heat of the heater module 220. However, the blocking flow may supply the external air to the thermostat 240 so as to cool the thermostat 240. This may prevent the erroneous operation of the thermostat due to the radiant heat of the heater module 220, thereby improving operation efficiency of the dryer.

However, when external air does not flow, it may cause the lack of air supplied into the heater module 220, thereby increasing the possibility of overheating the heater module 220. This case may require for a sensitive operation of the thermostat 240 to prevent the overheating of the heater module 220. Here, when external air does not flow, the external air may not be introduced through the slit. This may result in non-generation of the blocking flow. Hence, when the external air is not introduced through the slit 241, the thermostat 240 may be allowed to contact air heated by the heater module 220. Accordingly, as the air heated by the heater module 220 directly contacts the thermostat 240, the thermostat 240 may fast detect the overheating of the heater module 220.

Meanwhile, the heater assembly 210 may further include a passage guide 242 for guiding a flow path of external air introduced through the slit 241. Referring to FIG. 10, the passage guide 242 may be formed beneath the upper surface 233 on which the slit 241 is formed, and extend toward the thermostat 240 from the lower side of the slit 241. As another embodiment, the passage guide 242 may have a shape whose width is reduced as extending toward the thermostat 240.

The passage guide 242 may forcibly form a passage for guiding external air to flow toward the thermostat 240. This may further improve the efficiency of the aforementioned blocking flow by the external air. With the configuration, the external air which is introduced through the slit 241 so as to form the blocking flow may flow more smoothly. This may prevent the unnecessary turn-off of the heater module 220 by the thermostat 240, thereby improving efficiency of the dryer.

Figure 11:
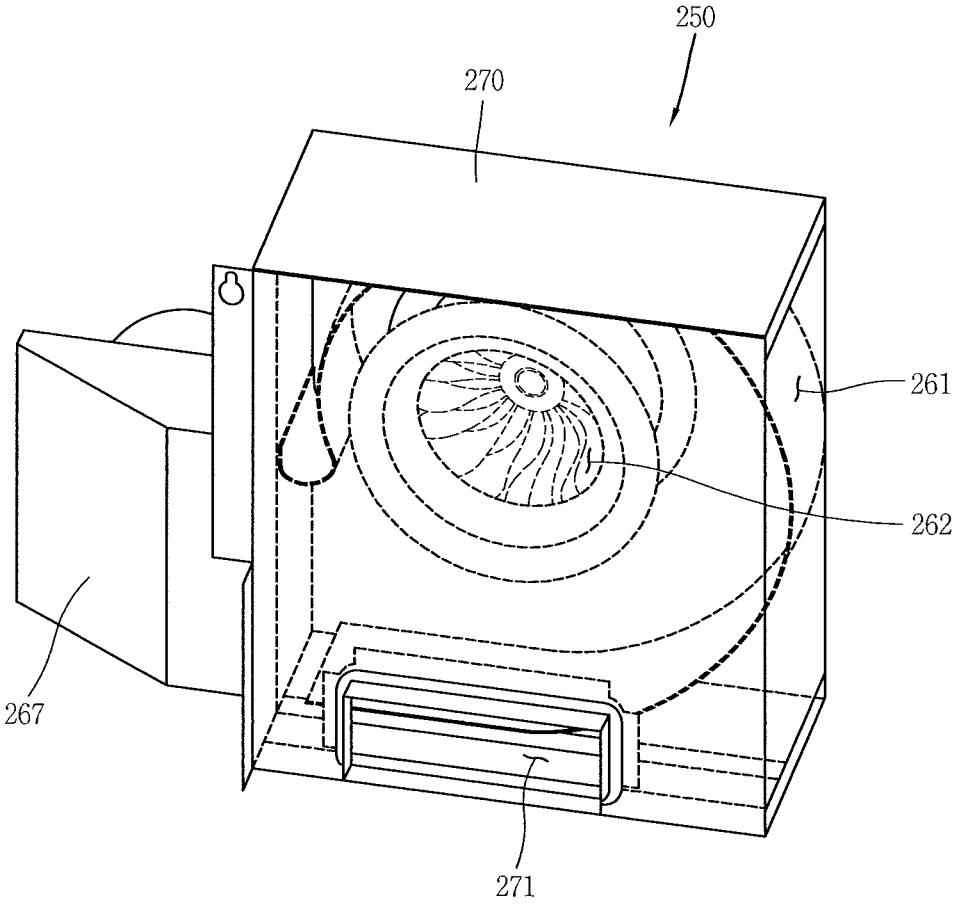
FIG. 11 is a schematic view showing a blower assembly.

FIG. 11 shows the blower assembly 250. Referring to FIG. 11, the blower assembly 250 may include a blower casing 270, and a blower fan 261 and a fan motor 265 both disposed within the blower casing 270, and an exhaust port 267.

Air discharged from the drum 110 through the exhaust duct 160 may be discharged through the exhaust port 267 by the blower fan 261. That is, the air flowed through the exhaust duct 160 may be introduced into the blower casing 270 via an inlet port 271 formed on a lower portion of the blower casing 270. The introduced air may be sucked by the blower fan 261 to be transferred toward the exhaust port 267 via a fan housing 262.

The fan motor 265 for driving the blower fan 261, as shown in FIG. 1, may be connected to an outside of the blower casing 270. The fan motor 265 may be provided, separate from the driving motor 130 of the main body 100, so as to increase an amount of air to be supplied to the drum 110 by use of the blower fan 261.

Figure 12:
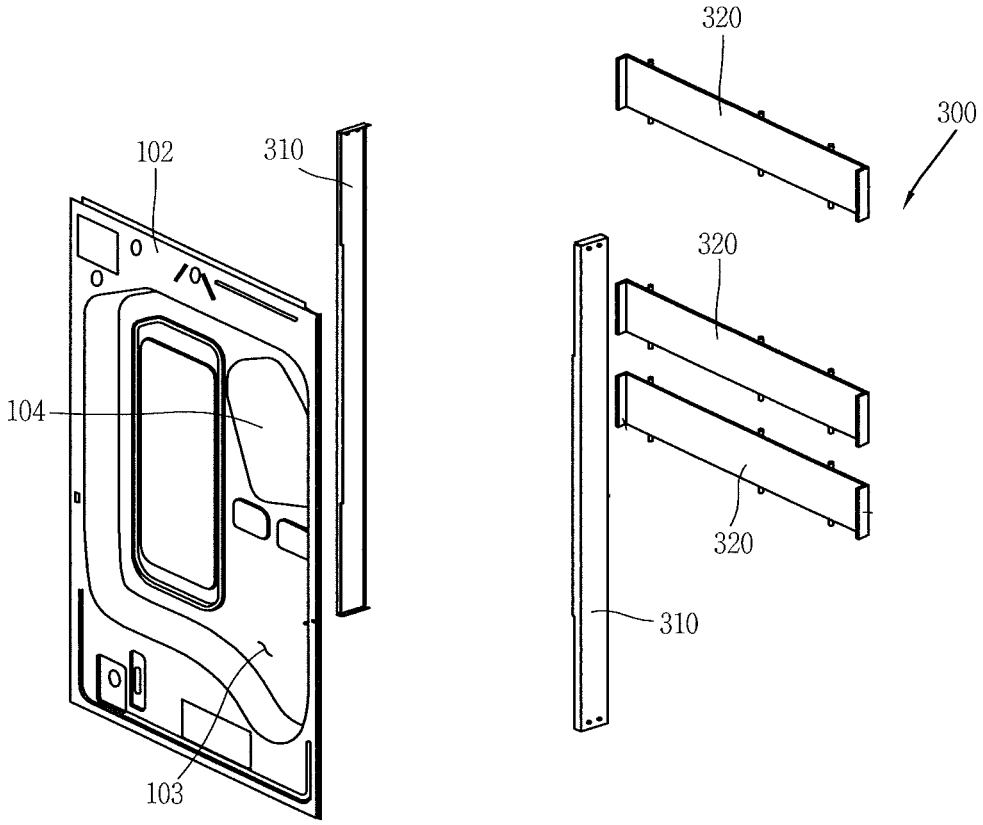
FIG. 12 is a disassembled perspective view showing a link unit.

FIG. 12 shows a link unit 300 for connecting the main body 100 and the module part 200 to each other. Referring to FIG. 12, the link unit 300 may include a pair of support frames 310 for coupling the main body 100 and side surfaces of the module part 200 to each other, and a plurality of guide frames 320 for supporting the support frames 310 in a connected state.

The support frames 310 may be disposed in a perpendicular direction. One side surface of each support frame 310 may be coupled to a rear end portion of each side panel of the cabinet 101. Also, another surface of each support frame 310 may be coupled to a front end portion of each of both side surfaces of the housing 290. Accordingly, the rear panel 102 and the module part 200 may be coupled to each other by a predetermined interval therebetween. In addition, the module part 200 may be connected to the cabinet 101 regardless of a protruded level of the protruding portion 103 formed on the rear panel 102. That is, the link unit 300 may connect the module part 200 to the cabinet 101 regardless of the shape of the rear panel 102. Thus, the module part 200 may also be connected to a rear side of the main body 100.

Figure 13:
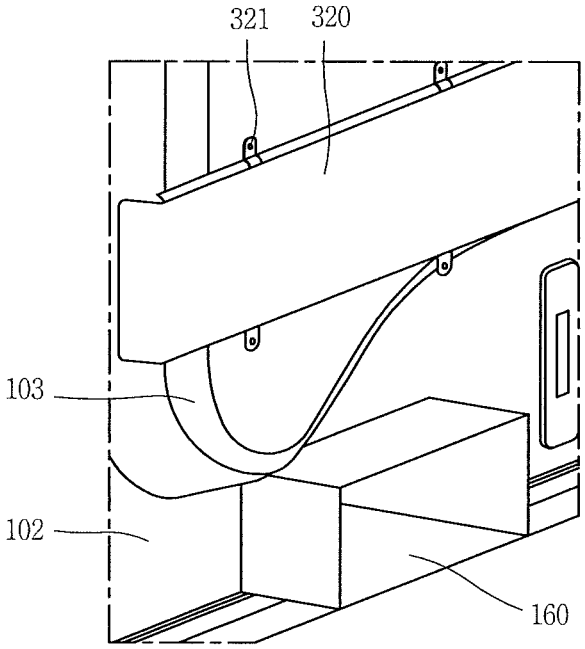
FIG. 13 is a schematic view showing a state that the link unit is partially coupled to a rear panel.

The guide frames 320 may be disposed in a horizontal direction, and provided in plurality for supporting the support frames 310 in the connected state. However, the guide frames 320 may not obscure a through hole 104 formed through the rear panel 102. Also, as shown in FIG. 13, the guide frames 320 may be coupled to the protruding portion 103 of the rear panel 102 by screws 321. The support frames 320 may thusly be supported more stably.

As the heater assembly and the blower assembly are disposed within the module part, separate from the main body, a large heater and a large blower fan may be employed regardless of the size of the main body of the dryer, allowing for drying of a large quantity of clothes in the dryer. In addition, the module part may be connectable to a random dryer, which may reduce the requirement for fabricating a separate cabinet of the dryer. This may result in improvement of generality and usability and reduction of fabricating costs.

The main body and the module part may be connected to each other not directly but via the link unit. This may reduce the probability that the rear panel located at the rear of the main body changes in shape. Accordingly, the module part may be mounted regardless of the shape of the rear panel. That is, even if a separate module part is connected to the dryer, the module part may not affect the rear portion of the cabinet of the dryer, thereby providing the dryer with structural stability.

Figure 14:
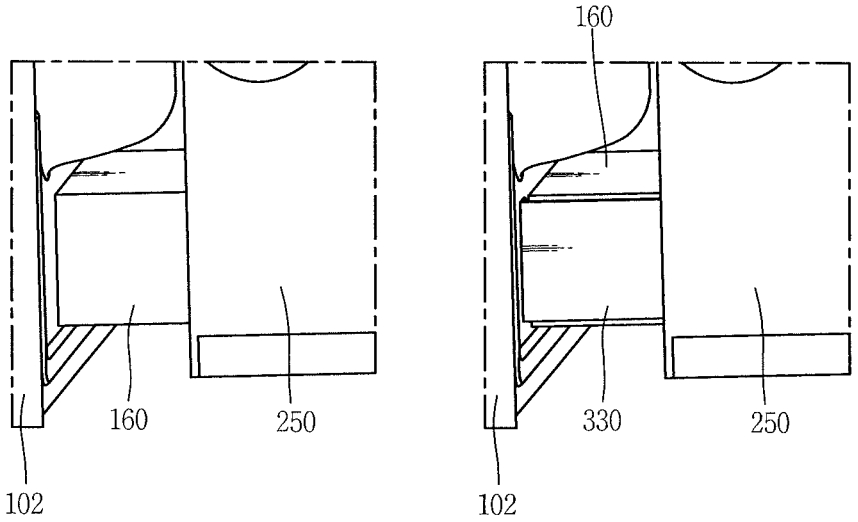
FIG. 14 is a schematic view showing a duct support frame for supporting an exhaust duct.

FIG. 14 shows a duct support frame which may be additionally provided on the link unit. Referring to FIG. 14, the exhaust duct 160 may extend from the rear panel 102 toward the blower assembly 250.

The main body 100 and the module part 200 may be coupled to each other partially with a gap therebetween due to the support frames 310 of the link unit 300. Accordingly, the exhaust duct 160 may be connected to the main body 100 and the module part 200 without any structural supporting. Therefore, a duct support frame 330 for preventing damage on the exhaust duct 160 during an installation or operation of the dryer may be disposed on the link unit 300.

The duct support frame 330 may support the exhaust duct 160 between the rear panel 102 and the blower assembly 250 of the module part 200. In detail, the duct support frame 330 may have one end coupled to the rear panel 102 and the other side coupled to the blower casing 270 of the blower assembly 250. Here, the duct support frame 330 may be located adjacent to the side surface of the exhaust duct 160. The duct support frame 330 may be disposed only at one side surface of the exhaust duct 160 or at a periphery of the exhaust duct 160.

Figure 15:
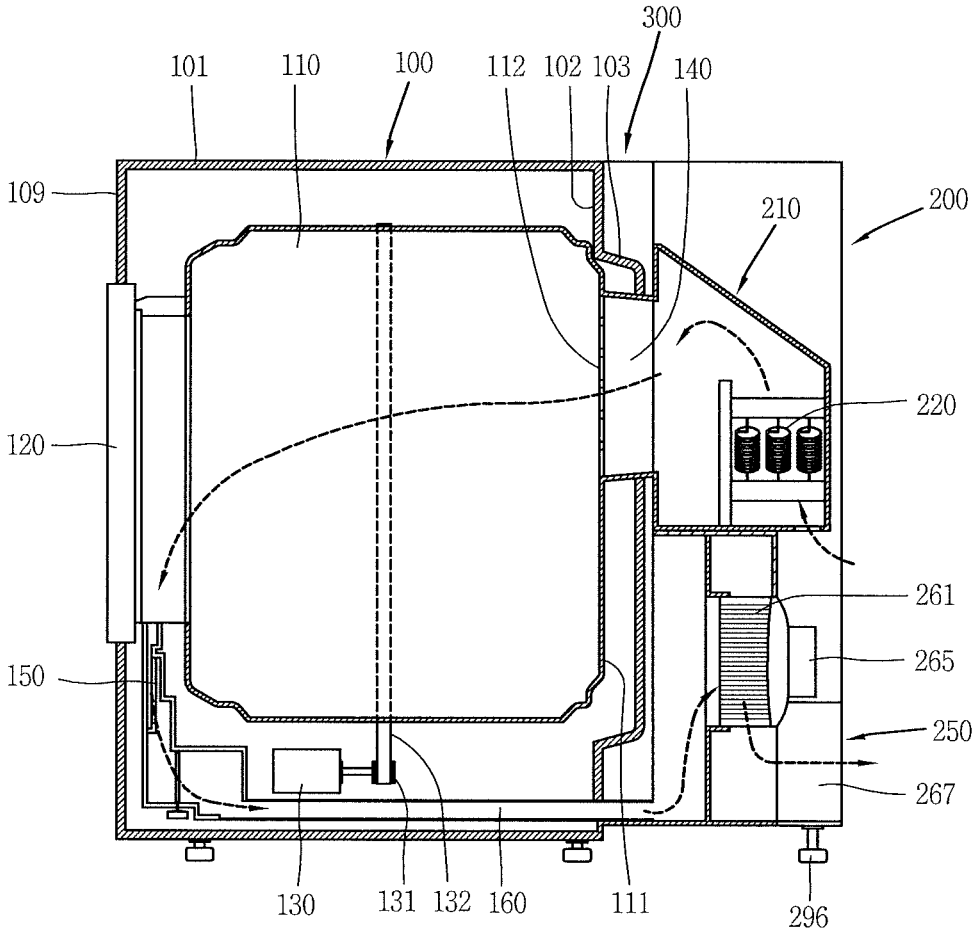
FIG. 15 is a schematic view showing an air flow in accordance with the one exemplary embodiment.

FIG. 15 schematically shows an air flow that external air introduced into the dryer according to the one exemplary embodiment is supplied into the drum and then discharged. Referring to FIG. 15, external air may be introduced into the air inlet port 294. The air flowed into the housing 290 via the air inlet port 294 may be introduced into the heater assembly 210 via the rear air inlet port 235*a* formed through the rear surface 235 of the heater casing and the lower air inlet 234*a* formed through the lower surface 234 of the heater casing.

The air introduced into the heater assembly 210 may then flow to a lower portion of the heater module 220 and heated in the heater module 220. The hot air generated in the heater module 220 may be supplied into the drum 110 through the through hole 231*a* of the front surface via the upper surface 233 of the heater casing.

Air which has been discharged after being used for drying within the dryer may be transferred to the blower assembly 250 by the blower fan 261. In detail, as aforementioned, the air discharged out of the drum 110 may be transferred to the blower assembly 250 through the exhaust duct 160 after flowing through the filter 150. As described with reference to FIG. 11, air introduced into the lower inlet port 271 of the blower casing 270 may be discharged to the outside through the exhaust port 267.

Figure 16:
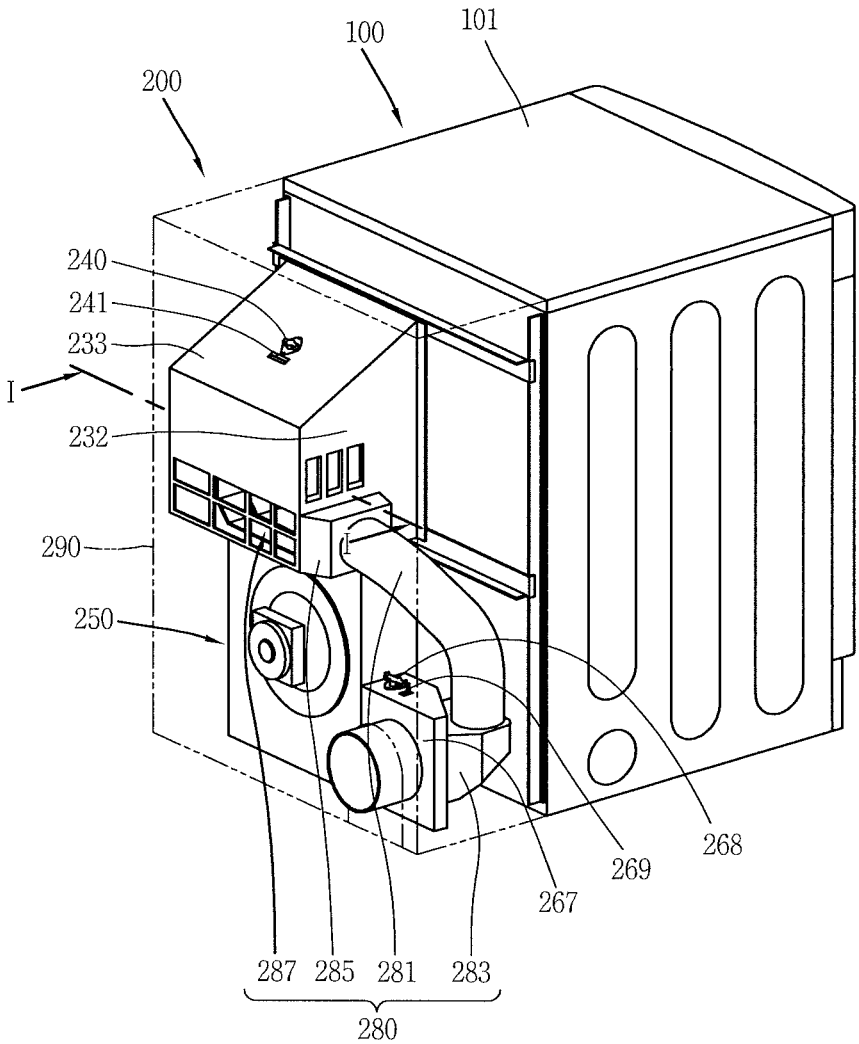
FIG. 16 is a rear perspective view of a clothes treating apparatus having a drying operation in accordance with another exemplary embodiment.
Figure 17:
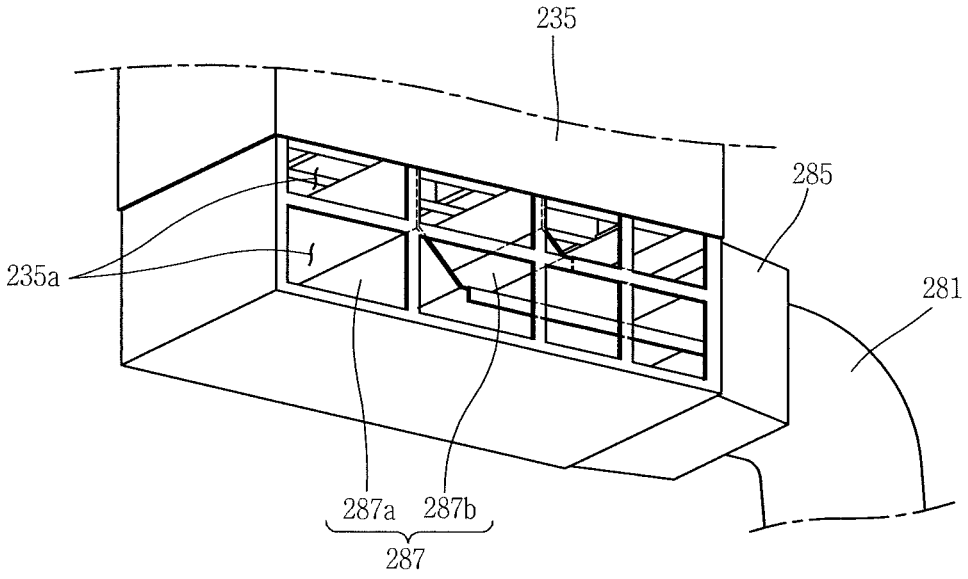
FIG. 17 is an enlarged perspective view of an air introduction portion of a heater assembly shown in FIG. 16.
Figure 18:
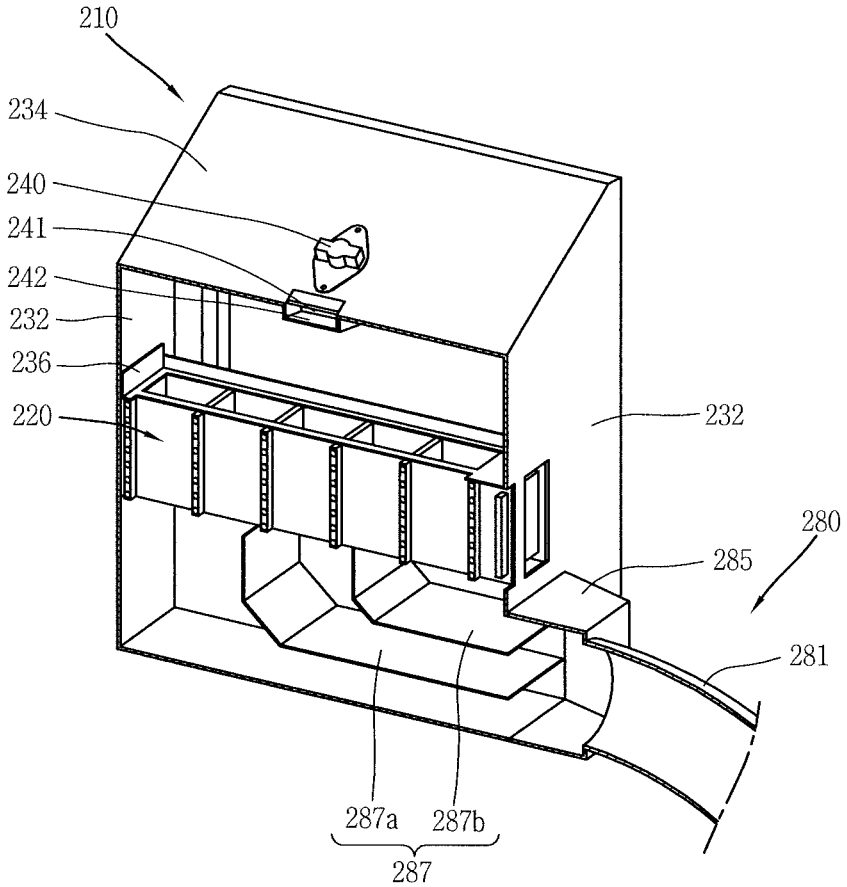
FIG. 18 is a sectional view taken along the line I-I of FIG. 16.

In accordance with another exemplary embodiment, a dryer may further include a bypass unit 280. FIG. 16 is a rear perspective view showing a dryer in accordance with the another exemplary embodiment, FIG. 17 is an enlarged perspective view showing an air introduction portion of the heater assembly shown in FIG. 16, and FIG. 18 is a sectional view taken along the line I-I of FIG. 16.

The bypass unit 280 may transfer a part of air discharged via an exhaust port 267 toward the heater assembly 210. The bypass unit 280 may include a bypass duct 281, first and second connectors 283 and 285, and a distributing member 287.

The bypass duct 281 is a tube with an inner diameter, and may have one end communicating with the exhaust port 267 and the other end communicating with the lower portion of the heater casing. The bypass duct 281 may extend from one side of the exhaust port 267 up to the side surface 232 of the heater casing. Also, the bypass duct 281 may be formed to be curved, as shown in FIG. 16.

The first connector 283 is a polyhedron with one surface inclined, and may be hollow. The first connector 283 may fix one end of the bypass duct 281 onto the exhaust port 267 to communicate with each other. In detail, a side surface of the first connector 283 may be connected to the exhaust port 267, and an upper surface of the first connector 283 may be connected to the bypass duct 281. A surface of the first connector 283 which faces a surface of the first connector 283 communicating with the exhaust port 267 may be inclined such that air transferred from the exhaust port 267 into the bypass duct 281 can be smoothly introduced into the bypass duct 281.

The second connector 285 has a shape similar to a hexahedron whose inside is hollow. The second connector 285 may fix the other end of the bypass duct 281 onto a lower portion of the side surface 232 of the heater casing so as to communicate with the heater casing. The second connector 285 may have one side surface open to be fixed onto the side surface 232 of the heater casing, and the other side surface communicating with the bypass duct 281.

The distributing member 287 may include a plurality of distribution plates 287*a* and 287*b*. The plurality of distributing plates 287*a* and 287*b* may guide air introduced into the heater casing via the second connector 285 to be evenly distributed to the heater module 220. Referring to FIGS. 17 and 18, each distributing plate 287*a* and 287*b* is a plate which has a predetermined width and also has a bent portion. Each of the distributing plates 287*a* and 287*b* may extend from the second connector 285 in a horizontal direction and then extend up to a lower portion of the heater module 220 in an inclined state. The distributing plates 287*a* and 287*b* may be disposed with being spaced from each other by uniform intervals, thereby dividing an open section of the second connector 285 into three uniform parts in up and down directions. Hence, air introduced into the heater casing via the second connector 285 may be distributed by the distributing plates 287*a* and 287*b* to be evenly introduced into the lower portion of the heater module 220. Also, an edge of the distributing plates 287*a* and 287*b* in a lengthwise direction may face the rear surface 235 such that external air introduced via the rear air inlet port 235*a* can flow into the heater module 220 with being mixed with air introduced via the bypass duct 281.

When the distributing member 287 is installed, the lower air inlet port 234*a* may not be formed on the lower surface 234 of the heater casing. Also, as aforementioned, the distributing member 287 may be fixed onto the second connector 285, the heater casing, or the end portion of the bypass duct 281.

Figure 19:
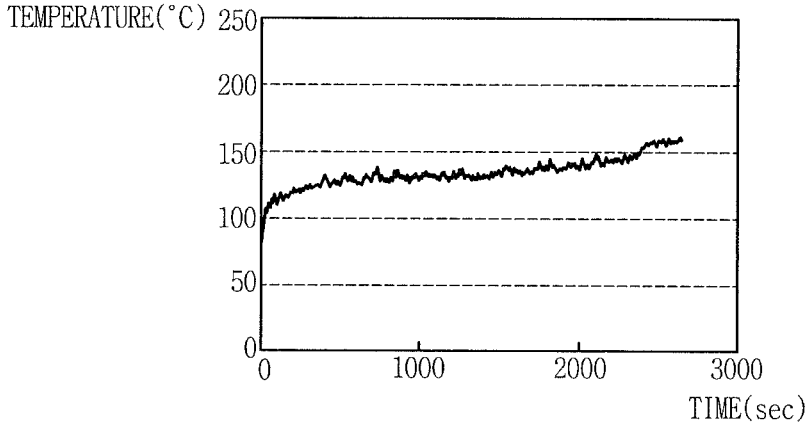
FIG. 19 is a graph showing temperature of air transferred from the heater assembly into a drum in accordance with the one exemplary embodiment shown in FIG. 1.
Figure 20:
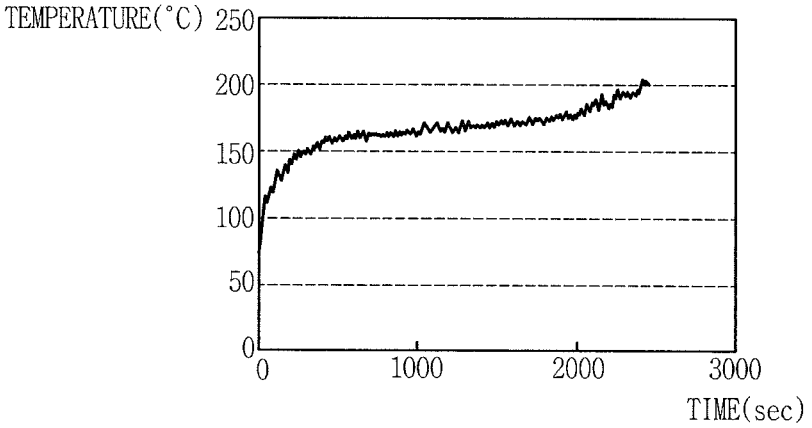
FIG. 20 is a graph showing temperature of air transferred from a heater assembly into a drum in accordance with the another exemplary embodiment shown in FIG. 16.

FIG. 19 is a graph showing changes in temperature based on a time with respect to air, which is heated in the heater module 220 and then supplied into the drum 110, in the dryer according to the one exemplary embodiment, namely, in the dryer without the bypass unit 280, and FIG. 20 is a graph showing changes in temperature based on a time with respect to air, which is heated in the heater module 220 and then supplied into the drum 110, in the dryer according to the another exemplary embodiment, namely, in the dryer with the bypass unit 280.

The X-axis of each graph shown in FIGS. 19 and 20 indicates a time by a unit of second, and the Y-axis thereof indicates a temperature of air, which is transferred after being heated in the heater module 220, by a unit of ° C. Referring to FIG. 19, when air used for drying in the drum 110 is all discharged from the blower assembly 250 via the exhaust port 267 without being recycled, namely, when only external air is heated in the heater module 220 to be supplied into the drum 110, a time taken until the temperature of the heated air prior to being introduced into the drum 110 reaches 150° C. may exceed 2000 seconds. On the contrary, referring to FIG. 20, when the air used for drying in the drum 110 is partially recycled, that is, external air and air to be used for drying are both heated by the heater module 220 and then supplied into the drum 110, a time taken until the temperature of the heated air prior to being introduced into the drum 110 reaches 150° C. may be about 200 seconds.

Therefore, the air which has been used for drying may be recycled, thereby reducing power consumed in the heater module 220 during a drying operation. Also, the heated air supplied into the drum 110 may reach a specific temperature within a relatively short time, thereby reducing a drying time.

Referring back to FIG. 16, the dryer according to the another exemplary embodiment may further include an auxiliary thermostat 268 and a temperature sensor (e.g., thermistor) 269 disposed on one side of the exhaust port 267, if necessary. The auxiliary thermostat 268 may automatically power the heater module 220 off when the temperature within the exhaust port 267 is more than a predetermined temperature. The thermistor 269 may send the temperature of the exhaust port 267 to a control unit for controlling the dryer.

Figure 21:
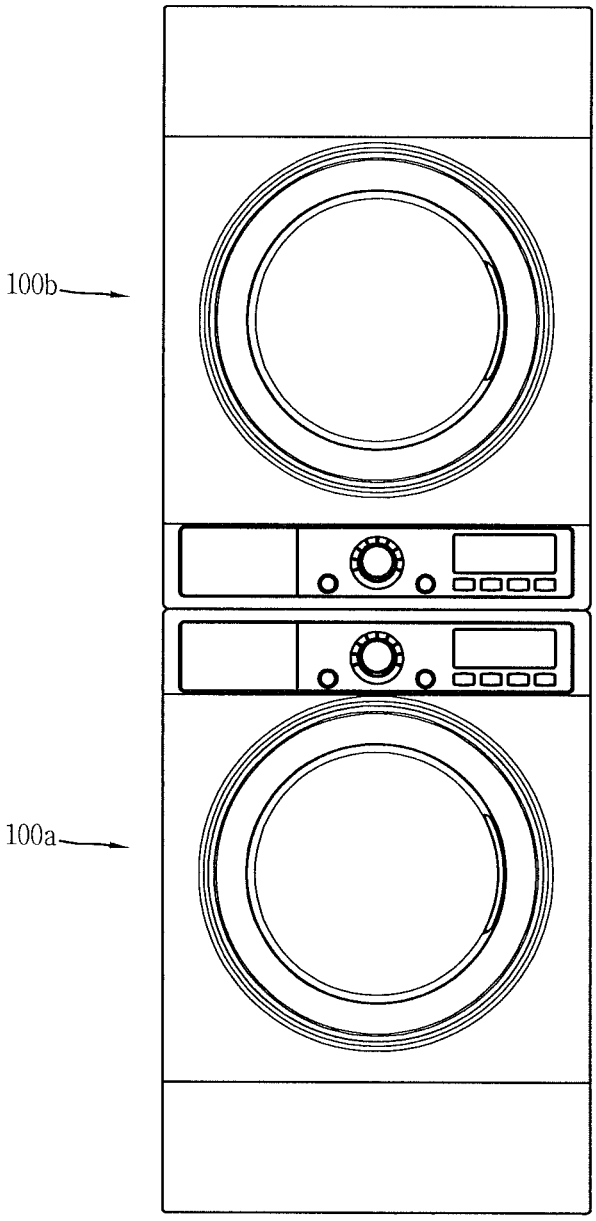
FIG. 21 is a schematic view showing a stacked state of a plurality of clothes treating apparatuses having a drying operation in accordance with one exemplary embodiment.

In the meantime, a dryer may be provided in plurality, if necessary, and the plurality of dryers may be stacked on each other. FIG. 21 shows a stacked state of the plurality of dryers. FIG. 21 shows two dryer main bodies 100*a* and 100*b* stacked in a perpendicular direction. However, this embodiment is merely illustrative, and two or more dryer main bodies may be stacked or arranged side by side.

When the dryers are stacked perpendicularly, the module parts 200 as well as the main bodies 100 have to be stacked perpendicularly. Therefore, FIGS. 22 and 23 show a configuration for stacking the module parts.

Figure 22:
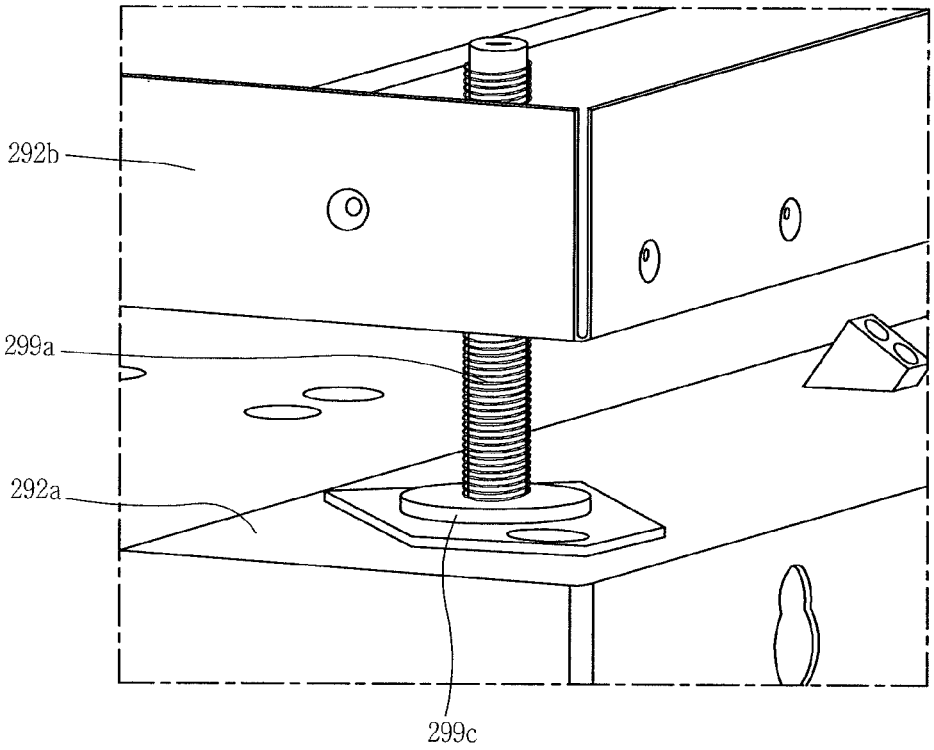
FIGS. 22 and 23 are schematic views showing a connected state of module parts of the plurality of the clothes treating apparatuses stacked on each other.
Figure 23:
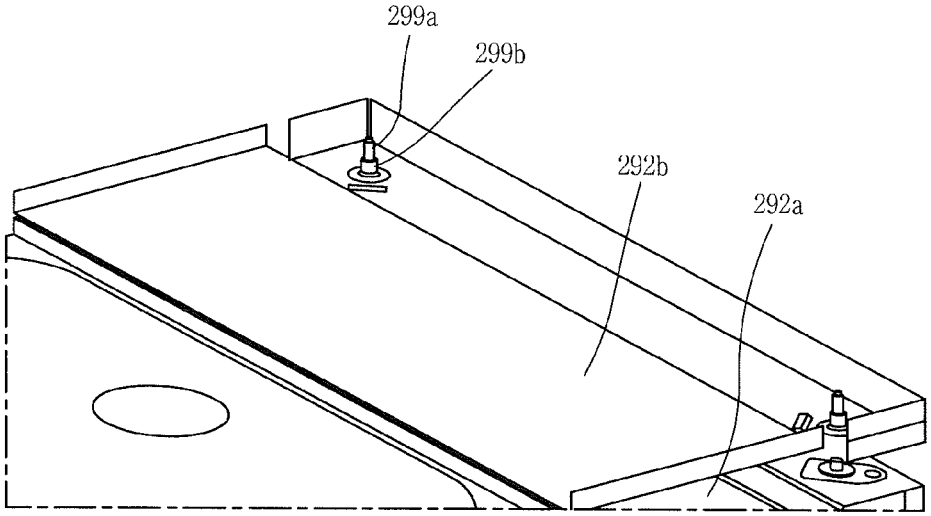

Referring to FIGS. 22 and 23, in a state that a plurality of module parts are connected in the perpendicular direction, a lower surface 292*b* of a housing of an upper module part and an upper surface 292*a* of a housing of a lower module part may be coupled to each other by supporting bolts 299*a* and nuts 299*b* to maintain an interval therebetween.

As aforementioned, the upper surface and the lower surface of the housing are fabricated in the same shape. Therefore, through holes through which legs are inserted may be formed at the same positions. Instead of using the legs, supporting bolts may be inserted to couple the upper module part and the lower module part to each other with a spaced distance therebetween.

In FIG. 22, the supporting bolt 299*a* may be supported at an opposite side of the nut 299*b* by a leg bracket 299*c*. Although not shown, this is equally applied to both the upper and lower module parts.

With this configuration, even when a plurality of dryers are used in a stacked state to have high spatial efficiency, the module parts may be mounted without use of a separate coupling member, resulting in improvement of generality and usability of the dryer.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus having a drying function comprising:

a cabinet adapted to receive a rotatable drum therein, the cabinet defining an appearance of the apparatus;

a module part mounted onto an outer surface of the cabinet, the module part comprising a heater assembly configured to heat air to be supplied to the rotatable drum, a blower assembly configured to discharge air inside the rotatable drum, and a housing configured to accommodate the heater assembly and the blower assembly; and a link unit configured to connect the module part onto a rear side of the cabinet, wherein the heater assembly comprises:

a heater casing including a front surface, a rear surface, side surfaces, a lower surface, and an upper surface, wherein the upper surface is, in part or fully, inclined and the heater casing includes air inlet ports formed through the lower surface and the rear surface, respectively, a heater module disposed within the heater casing and configured to heat air introduced into the heater casing, through the air inlet ports, a thermostat disposed on an inner side of the upper surface of the heater casing and configured to come in direct contact with the heated air from the heater module and to turn the heater module on or off according to temperature of air in the heater casing, a slit formed through the upper surface of the heater casing and configured to introduce external air into the heater casing to form a blocking flow of the external air, wherein based on the forming of the blocking flow, the heated air from the heater module is blocked from contacting the thermostat, and a passage guide formed beneath the slit on the upper surface of the heater casing and extending from a lower edge of the slit toward a lower side of the thermostat to guide a flow path of the blocking flow of the external air introduced through the slit, wherein the front surface of the heater casing is provided with a through hole through which heated air from the heater module is supplied into the rotatable drum via the upper surface of the heater casing, and wherein the heater assembly further includes a middle plate located between the heater module and the through hole of the front surface such that the air heated by the heater module flows along the upper surface of the heater casing and supplies into the drum through the through hole.

2. The apparatus of claim 1, wherein external air introduced into the housing is transferred to the heater assembly through the air inlet ports.

3. The apparatus of claim 1, further comprising a filter provided to a front lower side of the drum, wherein air used for drying in the drum is discharged to a front lower side of the drum, and then transferred to the blower assembly after removal of foreign materials by the filter.

4. The apparatus of claim 1, wherein the passage guide has a shape whose width is reduced as extending toward the thermostat.

5. The apparatus of claim 1, wherein the housing comprises at least one air inlet port to supply external air into the heater assembly.

6. The apparatus of claim 1, further comprising an exhaust duct to allow air discharged from the drum to flow into the blower assembly.

7. The apparatus of claim 6, wherein the blower assembly comprises:

a blower casing;

a blower fan disposed within the blower casing; and an exhaust port to discharge air flowed through the blower fan to the outside, wherein the air discharged from the drum via the exhaust duct is discharged through the exhaust port by the blower fan.

8. The apparatus of claim 7, wherein air discharged externally through the blower assembly is transferred to the heater assembly by a bypass unit disposed between the exhaust port and the heater assembly.

9. The apparatus of claim 8, wherein the bypass unit comprises a bypass duct to connect the exhaust port with the heater casing.

10. The apparatus of claim 9, wherein the bypass unit further comprises a first connector to connect a first end of the bypass duct onto the exhaust port to thereby allow communication between the bypass duct and the exhaust port and the bypass unit further comprises a second connector to connect a second end of the bypass duct onto the heater casing to thereby allow communication between communicate the bypass duct and the heater casing.

11. The apparatus of claim 10, wherein the bypass unit further comprises a distributing member to distribute air transferred from the bypass duct to the heater module.

12. The apparatus of claim 11, wherein the distributing member comprises a plurality of distribution plates to guide air introduced into the heater casing via the second connector to be evenly distributed to the heater module.

* * * * *